US005209668A

United States Patent [19]

Higano et al.

[11] Patent Number: 5,209,668

[45] Date of Patent: May 11, 1993

[54] SOCKET WITH A LAMP WITHOUT A METALLIC BASE

[75] Inventors: Masato Higano, Tochigi; Munehiko Yanagida, Utsunomiya; Tetsuya Sato, Utsunomiya; Masakazu Yanagiya, Utsonomiya, all of Japan

[73] Assignee: Moriyama Sangyo Kabushiki Kaisha, Tokyo, Japan

[21] Appl. No.: 834,530

[22] PCT Filed: Jul. 3, 1991

[86] PCT No.: PCT/JP91/00895

§ 371 Date: Feb. 11, 1992

§ 102(e) Date: Feb. 11, 1992

[87] PCT Pub. No.: WO92/01320

PCT Pub. Date: Jan. 23, 1992

[30] Foreign Application Priority Data

Jul. 6, 1990 [JP] Japan ..... 2-179305

[51] Int. Cl.[5] ..... H01K 1/46

[52] U.S. Cl. ..... 439/57; 313/318; 439/619

[58] Field of Search ..... 439/56, 57, 611, 612, 439/619, 699; 313/315, 318

[56] References Cited

U.S. PATENT DOCUMENTS 3,859,554 1/1975 Preziosi et al. ..... 439/57
4,795,373 1/1989 Fitzgerald et al. ..... 439/699

FOREIGN PATENT DOCUMENTS 3020309 12/1981 Fed. Rep. of Germany ..... 313/318
56-88275 7/1981 Japan .
60-254579 12/1985 Japan .
61-193386 8/1986 Japan .

*Primary Examiner*—Neil Abrams
*Attorney, Agent, or Firm*—Spencer, Frank & Schneider

[57] ABSTRACT

A contact strip for use with lamp socket devices where an electrical connection is made by the contact strip between a lamp lead and a circuit board conducting surface when the contact strip is assembled in a lamp socket device and mounted on the circuit board. At least one welding area at which a lead of a lamp is welded during assembly of the contact strip in a lamp socket device is provided. The contact strip includes upper and lower electricity receiving strip portions for receiving a circuit board therebetween and for making electrical contact with at least one of upper and lower conducting surfaces of the circuit board.

12 Claims, 4 Drawing Sheets

SOCKET WITH A LAMP WITHOUT A METALLIC BASE

BACKGROUND OF THE INVENTION

1. Field of the Invention

The present invention relates to a socket with a lamp without a metallic base which socket is mounted on an electrically conductive board, such as a print board or a flexible board, when used, and to a method of manufacturing such a socket.

2. Background Information

One example (the first example) of a lamp without a metallic base which has been used as a small lamp for display, indication or illumination of guages, is a lamp generally called a wedge base lamp, and a socket thereof. This example employs a socket device in which: a pair of metallic electrode contact-strips are arranged inside a socket body which is previously formed of an electrically insulating material such as a synthetic resin; and the contact-strips mechanically clamp the wedge base of the lamp to hold the lamp inserted in the body and thus to electrically connect to lead wires laid on the outside of the base.

This socket device is constructed so that it is fitted and fixed in a mounting hole portion of an exterior conductive board and that, at the same time, the board electrodes and the contact-strips pressingly contact each other to form an electrical connection.

However, in such a construction of a socket having a lamp without a metallic base, the pressed contact between the lead wires and the contact-strips is sometimes insufficient, or contact failure between the lamp and the contact-strips may be caused by, e.g., deterioration of the elasticity of the contact-strips caused by use over time, which is likely to result in lighting failure or accidental flickering. Further, because of the construction and shape of such a socket, the socket has a drawback in that it fails to meet a strong contemporary market demand, i.e. the downsizing of lighting devices.

In order to solve such problems, an alternate structure of the contact portion (the second example) has recently been proposed and put into use. In the structure, instead of the metallic contact-strips in the above socket, lamp lead wires coiled around a portion of a flange of the socket body are used to directly contact the electrodes of the conductive board.

The second example, a so-called sub-miniature lamp type, achieves a downsizing of the entire lighting device including the lamp.

Since such a structure does not require complicated bent contact-strips, it avoids lighting failure resulting from the contact-strips. However, since the contact portion is formed by coiling the lead wires, the structure (without contact-strips) has its own problems. Because the contact portion around which the lead wires are coiled lacks elasticity, changes in the socket body over time caused by the heat cycle effect of the lamp being turned on and off may result in lighting failure. Tension on the lead wires occurring during the coiling process may act on a lamp sealing portion whose strength is reduced by glass internal strain caused during processing In such a case, a crack or slow leakage may occur. Further, if the lead wires coiled around the portion contacting the electrodes of an exterior board have wrinkles, a lighting failure may occur. Also, the lead wires are required to be relatively long for the coiling process. Such long lead wires makes it difficult to automate the coiling process or to achieve high-quality products because of the difficulty in maintaining the shape of the long lead wires. Still further, since the lead wires are used as contact points, a secondary process, i.e., plating the lead wires, is required at the final stage of the lamp manufacturing, in order to prevent oxidation of the contact surfaces. Thus, costs associated with this type of structure are appreciably higher.

In order to solve the problems set forth in the second example, a contact-strip structure and means for mounting such contact-strips has a proposed. In this third example, lead wires of a lamp are integrally pre-connected to previously-prepared contact-strips of a socket by, e.g. electric welding means. Then, such contact-strips are fixed to the socket at the same time the lamp is mounted on the socket.

However, with such a contact-strip structure and means for mounting the sockets, the operations of forming lead wires and positioning the lead wires to contact-strips as pre-processes of the electric welding process are difficult. Also, since the relatively bulky metal terminals are connected to the tips of the pliable and fine lead wire by the electric welding process, such contact-strips wobble and hardly stay in position or may be tangled and trapped by each other, before the lamp and two contact-strips are mounted on a socket body. Thus, aligning and restricting the parts for automatization of the mounting process on socket bodies is extremely difficult.

Therefore, realization of the structure and mounting means of the third example is reconsidered because of the anticipated problems in production cost and quality consistency.

Still another example of lighting devices of this type (the fourth example) has been proposed, in which, simultaneously with mounting contact-strips onto a socket body, lead wires of a lamp mounted beforehand are sandwiched between the contact-strips and grooves on the body to make connections between the lead wires and the contact-strips. However, in the fourth example, it is difficult to automatize the complicated mounting operations such as proper sandwiching of lead wires.

SUMMARY OF THE INVENTION

The objects of the present invention are to develop a socket with a lamp without a metallic base which solves all the above-mentioned problems in the conventional structures and to provide a method for manufacturing sockets with lamps without metallic bases at low cost, which enables thoroughly automated processing for labor savings in the production processes and upgraded product quality.

The present invention proposes a socket with a lamp without a metallic base which comprises a lamp without a metallic base, an electrically insulating socket body formed of synthetic resin and having a bottomed receiving-cylinder for the lamp and a flange on the outer periphery thereof, and a pair of electrically conductive metallic contact-strips which pressingly contact electrodes of an exterior electrically conductive board, and wherein: the pair of contact-strips are mounted, facing each other, on portions around the receiving cylinder of the socket body in a direction parallel with the direction of insertion of the lamp; the socket body has a work space in which exterior electric welding electrodes are inserted to reach each of the contact-strips mounted on the body; and lead wires of the lamp without a metallic base inserted in the receiving cylinder are placed through insertion holes provided on the bottom portion of the receiving cylinder, are laid along welding portions of the contact-strips, and are electrically welded thereon.

When the pair of electrically conductive metallic contact-strips are mounted on the socket body, they may be inserted in portions around the receiving cylinder in a direction intersecting the direction of insertion of the lamp.

Each of the welding portions may be a protruding ear-like strip formed by bending a portion of the contact strip. The welding portion may be formed on an end portion of the contact-strip or may be formed by bending after the welding process so as to become a stopper end of the contact strip.

The welding portion is not required to be at specific portions but may be on either obverse or reverse sides of the electricity receiving contact-portions. The work space may be formed, according to the manner the contact-strips are mounted, extending in a direction parallel with or intersecting the direction of the insertion of the lamp into the receiving hole.

On the other hand, the work space may be formed extending in the direction parallel to or intersecting the direction of the insertion of a lamp into the receiving hole.

The lead wires are placed either through the insertion holes provided on the bottom portion of the receiving cylinder for a lamp without a metallic base or through slits formed on the receiving cylinder for the lamp without a metallic base extending in the direction of the lamp insertion toward the portions where the contact strips are mounted, so that the lead wires are led to the corresponding welding portions on the conductive metallic contact-strips.

The electricity receiving contact-portions of the conductive contact-strips which are inserted transversely are formed as one-side-uncut portions (the uncut side being either in the rotational direction of the flange or the radial direction) by cutting and bending them out from the contact strips. Such a structure is practically effective because it provides the contact strips with elasticity in the direction of the contact with electrodes of an exterior conductive board.

A thus-constructed socket with a lamp without a metallic base according to the present invention is manufactured by effective processing means comprising the steps of: mounting the pair of contact-strips on a socket body previously formed of synthetic resin; mounting the lamp without a metallic base on the socket body; laying the lead wires of the lamp along welding portions of the contact-strips; and welding the welding portions and lead wires, which are pressed to contact each other, by electric welding electrodes which are inserted in a work space formed in the socket body.

However, when conductive metallic contact-strips which are inserted in a direction intersecting the direction of the insertion of the lamp without a metallic base are used in the processing steps, the lamp may be mounted on the body before the contact strips are mounted. In this case, the lead wires are placed along the reverse sides, i.e., the lower sides, of the welding portions of the contact strips.

A pair of conductive contact-strips used in the above-described structure according to the present invention are terminals which pressingly contact electrodes of an exterior conductive board and function as intermediating members connecting the board electrodes and the lamp lead wires. The contact strips and the lead wires are rigidly connected by electric welding, eliminating causes of contact failure therebetween.

The contact strips can be inserted into the socket body by an automatic processor as in the conventional art. The lead wires can be laid along the inserted contact strips by an operation from the lower side of the flange. Electric welding electrodes can be inserted in the work space provided in the socket body toward the contact strips and thus can weld the lead wires and the contact strips.

All these operations, i.e. inserting contact strips into a socket body, mounting a lamp on the body and the welding process, can be performed by an automatic processor.

The welding portion ear-like strips provided on the contact strips are bent to become portions separate from the other portions of the contact strips, particularly from press-contact electrode portions. Therefore, external forces, such as welding impact and pressing pressure from the welding electrodes during the welding of the lead wires, are absorbed by the bent portions and do not propagate over the entire contact strips.

In a case where the welding portions are on end portions of the contact strips, such portions effectively reduce the impact of the spot welding propagating to the other portions of the contact strips, particularly to the press-contact electrode portions, because the end portions are comparatively firmly supported in the socket body due to, e.g. the engagement made by the insertion of the contact strips therein. Further, in a case where stopper ends of the contact strips are formed by bending portions after welding the lead wires, the stopper ends are located sufficiently apart from the press-contact electrode portions during welding. Thus, the propagation of external forces such as impact between this distance can be reduced.

In a case where the conductive metallic contact-strips are narrow plates having cut-and-bent strips, arranging the contact strips in the direction of the insertion of the lamp makes an appropriate structure and facilitates the assembly operation by an automatic processor.

In a case where the conductive metallic contact-strips are short rails each having a sectional shape like an inverted "U" with sharp corners, the contact strips can be inserted into the socket body in a direction intersecting the direction of the lamp insertion, either before or after the lamp is mounted on the body. Therefore, designing processing machines, particularly an automatic processor, is easy, and also reliable assembling can be performed.

Normally, the pair of the lead wires of the lamp are drawn out downwards through the insertion holes provided on the bottom portion of the receiving cylinder, and then are spread apart to be laid along the welding portions of the contact strips mounted beforehand.

In a case where the conductive contact-strips are inserted in a direction intersecting the direction of the lamp insertion, besides the means for mounting lead wires, slits are provided in the receiving cylinder. In such a structure, lead wires are bent apart, like spread legs, at their portions close to the bottom of the lamp without a metallic base. The spread lead wires can be slid through the slits, simultaneously with the insertion of the lamp, to be laid on the upper surfaces of the contact strips previously mounted. The lead wires may be laid on the lower surfaces of the contact strips subsequently mounted.

Since a work space is specifically formed in the socket body, the electric welding electrodes can be relatively easily inserted. Therefore, the contact-strips structure can be simplified and operation efficiency can be upgraded.

When a lamp without a metallic base is inserted in the socket body after mounting the contact strips in the above-described method of manufacturing sockets, transition to the following process, i.e. laying the lamp lead wires on the welding portions of the contact strips, can be smoothly carried out.

When electric welding means is employed, at the final process of the assembly, between the contact strips and the lead wires laid thereon, the socket with a lamp constructed as described above is completed.

DETAILED DESCRIPTION OF THE PREFERRED EMBEDMENTS

Figure 1:
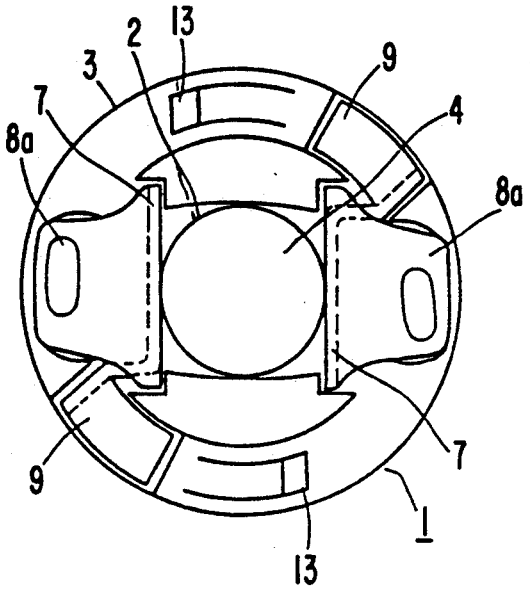
FIG. 1 is a plan view of one embodiment of a socket according to the present invention.
Figure 2:
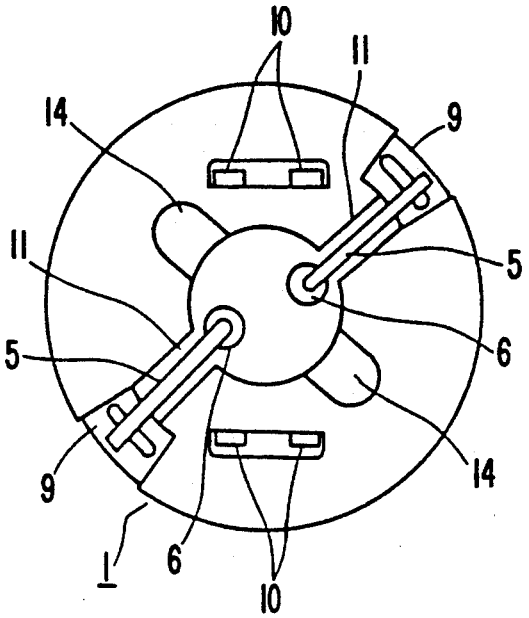
FIG. 2 is a bottom view of the embodiment of a socket according to the present invention shown in FIG. 1.
Figure 3:
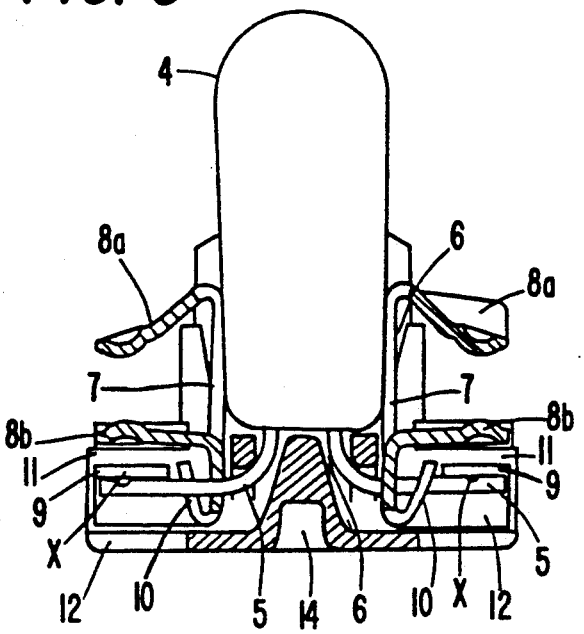
FIG. 3 is a central longitudinal section of the above embodiment.

In an embodiment shown in FIG. 1, a socket body 1 is formed of electrically-insulating synthetic resin. The socket body 1 has, at its central portion, a lamp-receiving cylinder 2 formed in the shape of a cylinder having a bottom. A flange 3 is formed at the periphery of the bottom portion of the cylinder. The bottom of the receiving cylinder 2 (FIG. 2) has small holes 6, 6 through which lead wires 5, 5 of a lamp without a metallic base 4 are inserted (FIG. 3).

Figure 4:
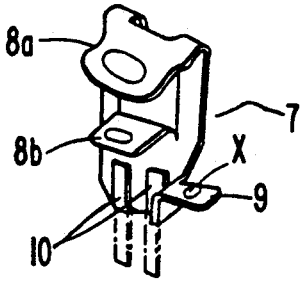
FIG. 4 is a perspective view of a contact-strip in the above embodiment.

Electrode contact-strips 7 (see FIG. 4) are formed by blanking out of electrically-conductive metallic plates. As shown by full lines in FIG. 4, each of the electrode contact-strips 7 has electricity-receiving strip portions 8*a*, 8*b* which clamp an exterior electrically-conductive board (not shown) in the direction of the thickness of the contact-strip 7. Each of the contact-strips 7 also has an ear portion 9 protruding sideways. A welding portion x is formed on the ear portion 9. Further, stopper ends 10 are formed so as to work as stoppers. After the contact-strip 7 is mounted on the socket body 1, the stopper ends 10 are folded, as shown in FIG. 4 by the chain lines, so as to keep the contact-strip 7 from slipping out of the body 1.

Guide grooves 11, 11 are cut out radially on the bottom surface of the body 1. The lead wires 5, 5 are put through the small holes 6, 6 and bent away from each other so that the lead wires 5, 5 lie in the grooves 11, 11 and face the lower sides of the ear portions 9 of the contact-strips 7.

Then, spot welding electrodes (not shown) are inserted in work spaces 12 so as to be positioned at the upper and lower sides of the ear portions 9. The work spaces 12 are formed by cutting out portions of the lower surface of the flange 3. Each free end of the lead wires 5, 5, which faces one of the ear portions 9, is thus welded to the welding portion x of each ear portion 9. In such a manner, the contact-strips 7 and the lead wires 5 are connected mechanically and electrically.

Further, in the embodiment shown in the above-mentioned figures, engaging stoppers 13 for a conductive board are formed at portions of the upper side of the flange 3 so as to prevent the socket body 1 from rotating in reverse to the direction of the rotational operation of the socket body 1 for mounting it on a board. Grooves 14 are formed in which tools for mounting a socket, such as the tip of a screw driver, are inserted.

Figure 5:
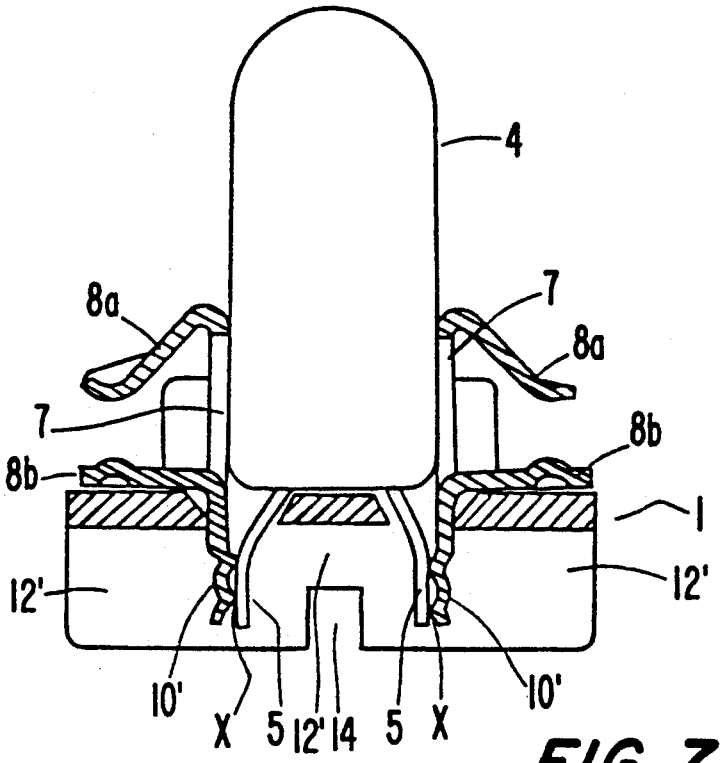
FIG. 5 is a central longitudinal section of another embodiment of the socket according to the present invention.

FIG. 5 is a central longitudinal section of another embodiment of the present invention. In this embodiment, a welding portion x of the contact-strip 7 is formed on the reverse side of each of cut-and-bent stopper ends 10', 10' extending down from the lower portion of the contact-strip 7. A work space 12', which enables spot welding electrodes to be positioned on either side of a set consisting of an end 10' and a lead wire 5 extending along the end 10', is formed transversely extending not only between the pair of stopper ends 10', 10' but further out beyond them. Functional parts, the same or similar to those of the foregoing embodiments are denoted by the same numerals.

Figure 6:
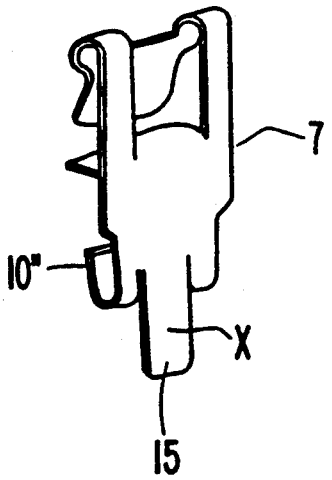
FIG. 6 is a perspective view of a contact-strip in still another embodiment according to the socket according to the present invention.
Figure 7:
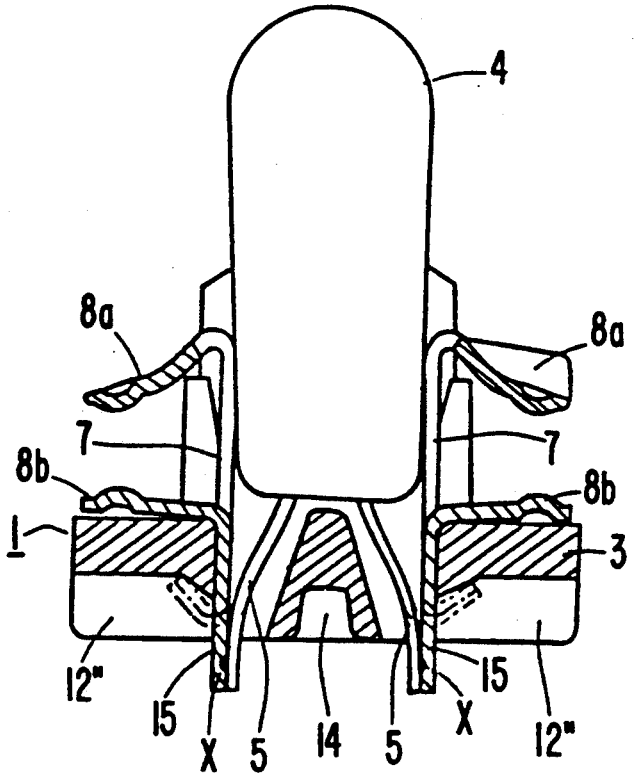
FIG. 7 is a central longitudinal section of an embodiment employing the contact-strip shown in FIG. 6.

Stopper ends of the contact-strip 7 may be bent-backward type stopper ends 10'', 10'' as shown in FIG. 6. In such a case, the reverse side of a vertical tongue strip 15 therebetween can be used as a welding portion x. The vertical tongue strip 15 protrudes from the bottom portion of a thin-type flange 3. Spot welding electrodes can reach the welding portion x thereof sideways, along the bottom surface of the flange 3. After welding, they are folded into work spaces 12'' formed by cutting out portions at bottom of the flange 3, as shown by chain lines in FIG. 7. In this embodiment, therefore, the flange 3 can be formed thin.

Figure 8:
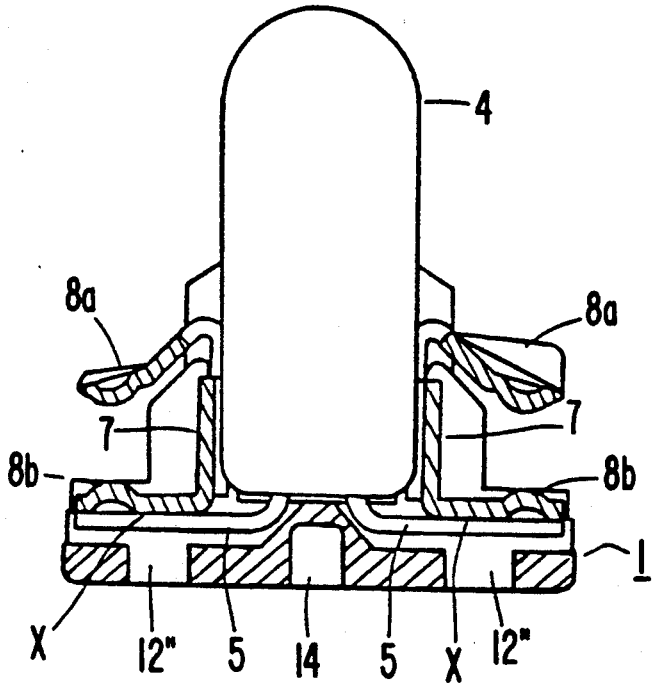
FIG. 8 is a central longitudinal section of a further embodiment of the socket according to the present invention.

The welding portion x does not necessarily have to be specifically formed for welding or located at a specific position. When contact-strips 7 and a flange 3 of a socket body 1 are constructed as shown in FIG. 8, a lead wire 5 may be directly welded to the reverse side of one end 8*b* of each of facing electricity-receiving portions. Functional parts which are the same or similar to those of the other embodiments are denoted by the same numerals.

Figure 9:
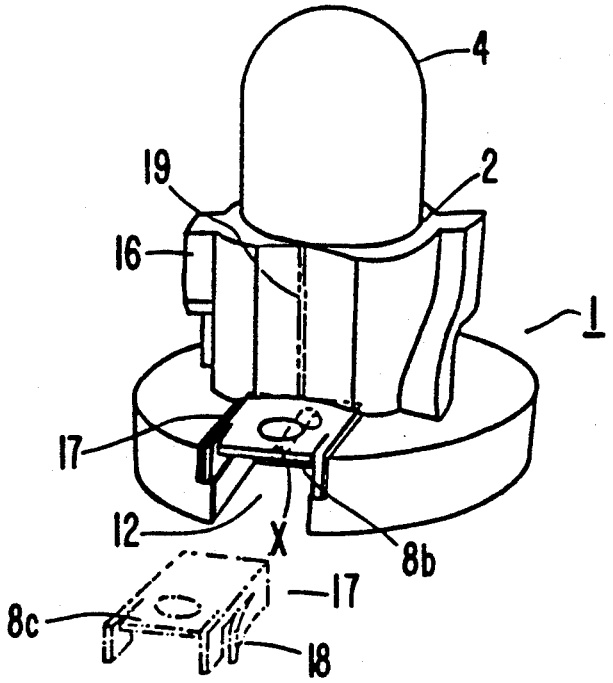
FIG. 9 is a side view of a still further embodiment of the socket according to the present invention.

FIG. 9 shows a still further embodiment. While the above embodiments comprise contact-strips which are formed so as to clamp an exterior contact board on the top and bottom surfaces, this embodiment comprises: engaging platforms 16 projecting from the outer periphery of a receiving cylinder 2 of a socket body 1; and contact-strips 17 having a cut-and-bent electricity-receiving portion 8c, which together clamp an exterior contact board. In this embodiment, the contact-strips 17 are formed so as to have a sectional shape like an inverted "U" with sharp corners. The contact-strips 17 are inserted toward the center of the socket body 1 in a direction intersecting the direction of insertion of a lamp 4 (in a direction along the flange bottom surface). The contact-strips 17 also have cut-and-bent stoppers 18 formed at the sides thereof, which engage with portions of the body 1 when inserted therein, thus preventing the contact-strips 17 from slipping out.

Further, in the embodiment shown in FIG. 9, slits 19 (shown by two-dot lines in the figure) may be formed by cutting open the peripheral wall of the receiving cylinder 2 in the direction of the insertion of the lamp 4 toward the portions where the contact-strips 17 are inserted. With this construction, lead wires 5, 5 of the lamp 4 are bent apart at the portions close to the lamp base and are positioned facing the slits 19, and thus the lead wires 5, 5 can be positioned at welding portions x of the contact-strips 17 instantly when the lamp 4 is inserted in the receiving cylinder 2. In this case, the contact-strips 17, 17 may be inserted in the socket body 1 either before or after the insertion of the lamp 4. If the the contact-strips 17, 17 are placed before the lamp 4, the lead wires 5, 5, which are subsequently placed, are positioned on top of the welding portions x of the contact-strips 17, 17. If the the contact-strips 17, 17 are placed after the lamp 4, the lead wires 5, 5, which are previously placed, are positioned on the lower side, i.e., the reverse side, of the welding portions x of the contact-strips 17, 17.

Figure 10:
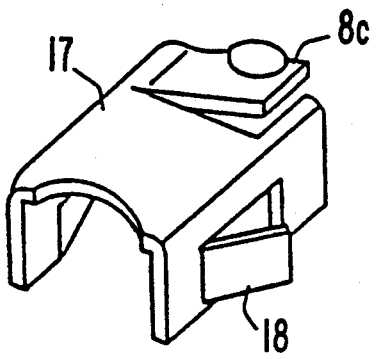
FIG. 10 is the perspective view of another embodiment of the electrically-conductive metallic contact-strip employed in a socket according to the present invention.
Figure 11:
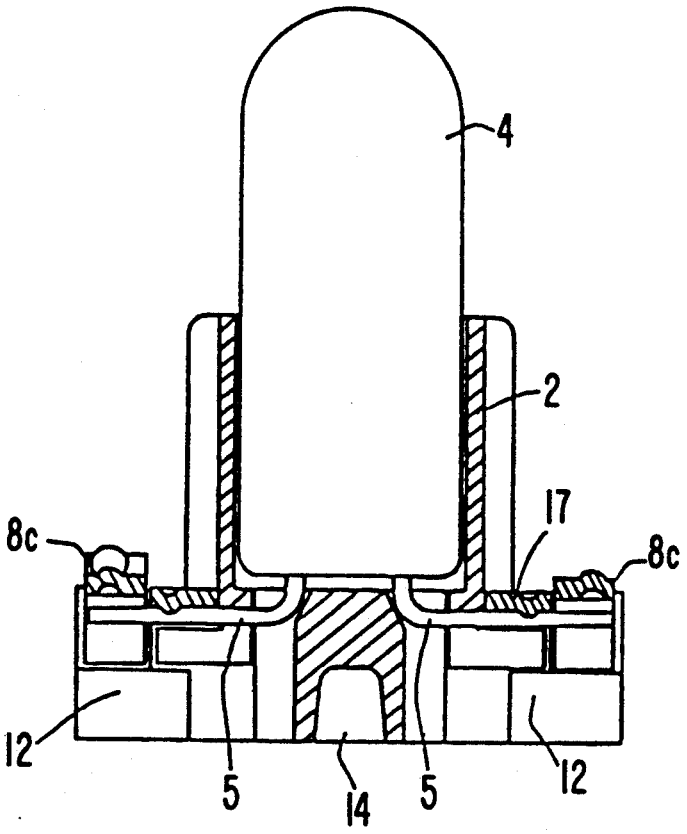
FIG. 11 is a central longitudinal section of still another embodiment employing the contact-strip shown in FIG. 10.

FIG. 10 shows still another embodiment of an electrically-conductive metallic contact-strip in a socket according to the present invention. Contact-strips 17, 17 have electricity-receiving portions 8c which are cut and bent following the direction of the rotation of the flange 3. The contact-strips 17, 17 are placed in the socket body 1 (see the central longitudinal sectional view shown in FIG. 11) in the following manner. The uncut end of each of the electricity-receiving portions 8c is ahead in the direction in which the flange 3 is rotated when the socket 1 is mounted on an exterior conductive board, and the cut end of the electricity-receiving portion 8c is at the other side.

Functional parts which are the same or similar to those of other embodiments are denoted by the same numerals.

As described above, since a socket according to the present invention employs contact-strips as structural parts in construction of the socket body, elastic force caused by the material and structure of contact-strips can be utilized. The elastic force provides contact pressure onto a conductive board. Despite repetition of the heat cycle caused by the lamp going on and off, the contact pressure does not substantially decrease over time. Thus, such a socket can be used for a long time and can substantially prevent the lighting failure caused by contact failure between contact strips and an exterior conductive board. Particularly since lead wires are rigidly connected to contact-strips by electric welding, and further, since this spot welding is performed after the contact-strips are mounted in the socket body, the forming process for lead wires and the positioning operation for the lead wires to the contact-strips preceding the welding process can be performed by an automatic processor with the socket body being held. Thus, all the processes for assembling socket bodies, i.e. from inserting contact-strips to fixing lead wires, can be performed by an automatic machine. As a result, manufacturing operation efficiency will be improved.

Also, since the lead wires can be positioned along welding portions of contact-strips without being subjected to, e.g., strong exterior tension, excessive strain on sealing bases of the lead wires does not occur. In other words, the causes of cracks or slow-leakage are eliminated. Thus, product quality can be upgraded.

Further, since a work-space is formed by cutting out a portion of the socket body, electric welding electrodes can reach welding portions through the work-space. Thus, means for welding lead wires after mounting of contact-strips can be employed.

When the welding portions are formed on protruding ear-like strips formed at specific sites of contact-strips, pressingly-contacting electricity receiving portions will not directly receive clamping pressure or impact acting on the welding portions during spot welding. This, the electricity receiving portions can be safely maintained in a predetermined shape for contact with a conductive board.

The same effect can be obtained if the welding portions are stopper ends of contact-strips. Such contact-strips do not require portions specifically formed for welding, thus effectively contributing to the simplification of the structure of contact-strips.

Further, if the stopper ends are bent back, after the spot welding, to obtain the stopping function, the spot welding can be performed relatively easily. For example, spot welding electrodes can clamp a stopper end which is not yet bent but extends downwards. In a case where a priority is given to the simplification of the contact-strip structure, the welding portions may not necessarily be located at specific sites on the contact-strips but may be e.g., on the reverse sides of the pressingly-contacting electricity receiving portions.

Still further, since a pair of contact-strips are mounted onto the socket body in the first process and a lamp is mounted onto the body in the second process, or since slits for guiding lead wires are provided on a socket body into which contact-strips are inserted in a direction intersecting the direction of the insertion of the lamp, the process of inserting the lamp and the process of laying the lamp lead wires on the contact-strips can be performed in a continuous operation, smoothly followed by the process of electrically welding the contact-strips and the lead wires.

Since the process of welding contact-strips and lead wires is performed after mounting them on a socket body, such a socket structure and manufacturing method thereof can be achieved.

Thus, a socket with a lamp without a metallic base according to the present invention can be used as illuminating devices in automobile guages, or is suitable as a light-source device in a display means comprising, e.g. many light-source lamps arranged in a grid.

We claim:

1. A contact strip for use with lamp socket devices whereby an electrical connection is made by the contact strip between a lamp lead and a circuit board conducting surface when the contact strip is assembled in a lamp socket device and mounted on the circuit board, the contact strip comprising:

at least one welding area at which a lead of a lamp is welded during assembly of the contact strip in a lamp socket device; and upper and lower electricity receiving strip portions for receiving a circuit board therebetween and for making electrical contact with at least one of upper and lower conducting surfaces of the circuit board.

2. The contact strip according to claim 1, further comprising an ear portion extending parallel to and below said lower electricity receiving strip portion, said at least one welding area being disposed on said ear portion.

3. The contact strip according to claim 1, further comprising a vertical tongue strip extending perpendicular to and below said lower electricity receiving strip portion, said at least one welding area being disposed on said vertical tongue strip.

4. The contact strip according to claim 1, further comprising stopper means for engaging a mounting portion of a socket body when assembled thereto, thereby preventing the contact strip from slipping out.

5. A lamp socket device having at least one pair of contact strips according to claim 1, comprising:

a lamp without a metallic base; and an electrically insulating socket body formed of synthetic resin, said socket body comprising a receiving-cylinder for receiving the lamp therein, and mounting portions disposed around the receiving cylinder oriented in a direction parallel with a direction of insertion of said lamp, for mounting the at least one pair of contact strips thereon;

wherein said socket body further comprises insertion holes disposed at a bottom portion of the receiving cylinder for receiving leads of the lamp therethrough when the lamp is inserted in said receiving cylinder, and a work space by which external welding electrodes may be inserted to reach welding areas of respective contact strips mounted on said socket body to weld the lamp leads to respective welding areas of the contact-strips.

6. The lamp socket device having at least one pair of contact strips according to claim 5, further comprising stopper means disposed on the contact strips for engaging said mounting portions of the socket body when the contact strips are inserted therein, thereby preventing the contact strips from slipping out.

7. The lamp socket device having at least one pair of contact strips according to claim 5, wherein the contact strips further comprise an ear portion extending parallel to and below said lower electricity receiving strip portion into said work space, said at least one welding area being disposed on said ear portion.

8. The lamp socket device having at least one pair of contact strips according to claim 5, wherein the contact strips further comprise a vertical tongue strip extending perpendicular to and below said lower electricity receiving strip portion into said work space, said at least one welding area being disposed on said vertical tongue strip.

9. A contact strip for use with lamp socket devices whereby an electrical connection is made by the contact strip between a lamp lead and a circuit board conducting surface when the contact strip is assembled in a lamp socket device and mounted on the circuit board, the contact strip comprising:

at least one welding area at which a lead of a lamp is welded during assembly of the contact strip in a lamp socket device; and an electricity receiving portion for contacting a surface of a circuit board;

wherein the contact strip has an inverted U shaped cross-section and extends perpendicularly to an insertion direction of a lamp in a socket device when assembled thereon.

10. The contact strip according to claim 9, wherein, with respect to said inverted U shaped cross-section, said at least one welding area is disposed on an inner surface of said contact strip and said electricity receiving portion is disposed on an outer surface of said contact strip.

11. The contact strip according to claim 9, further comprising stopper means for engaging a mounting portion of a socket body when inserted therein, thereby preventing the contact strip from slipping out.

12. A lamp socket device having at least one pair of contact strips according to claim 9, comprising:

a lamp without a metallic base; and an electrically insulating socket body formed of synthetic resin, said socket body comprising a receiving-cylinder for receiving the lamp therein, and mounting portions disposed around the receiving cylinder oriented in a direction perpendicular with a direction of insertion of said lamp, for mounting the at least one pair of contact strips therein;

wherein said socket body further comprise slit means disposed along side portions of the receiving cylinder for receiving leads of the lamp therethrough when the lamp is inserted in said receiving cylinder, and a work space by which external welding electrodes may be inserted to each welding areas of respective contact strips mounted on said socket body to weld the lamp leads to respective welding areas of the contact strips.

* * * * *